US010615022B2

(12) United States Patent
Böhm et al.

(10) Patent No.: US 10,615,022 B2
(45) Date of Patent: Apr. 7, 2020

(54) WIDE-RANGE HIGH MASS RESOLUTION IN REFLECTOR TIME-OF-FLIGHT MASS SPECTROMETERS

(71) Applicant: Bruker Daltonik GmbH, Bremen (DE)

(72) Inventors: Sebastian Böhm, Bremen (DE); Andreas Haase, Bremen (DE)

( * ) Notice: Subject to any disclaimer, the term of this patent is extended or adjusted under 35 U.S.C. 154(b) by 0 days.

(21) Appl. No.: 16/132,669

(22) Filed: Sep. 17, 2018

(65) Prior Publication Data

US 2019/0096651 A1 Mar. 28, 2019

(30) Foreign Application Priority Data

Sep. 28, 2017 (DE) ..... 10 2017 122 559

(51) Int. Cl.

*H01J 49/40* (2006.01)
*H01J 49/16* (2006.01)
*H01J 49/04* (2006.01)

(52) U.S. Cl.

CPC ..... *H01J 49/164* (2013.01); *H01J 49/0418* (2013.01); *H01J 49/403* (2013.01); *H01J 49/405* (2013.01)

(58) Field of Classification Search

CPC ..... H01J 49/405; H01J 49/403
See application file for complete search history.

(56) References Cited

U.S. PATENT DOCUMENTS 4,072,862 A 2/1978 Mamyrin et al.
4,731,532 A 3/1988 Frey et al.
5,739,529 A * 4/1998 Laukien ..... H01J 49/065 250/282
5,969,348 A * 10/1999 Franzen ..... H01J 49/403 250/282

(Continued)

FOREIGN PATENT DOCUMENTS

DE 19638577 C1 1/1998
GB 2295720 A 6/1996

(Continued)

OTHER PUBLICATIONS

R. Weinkauf, et al., "Laser Tandem Mass Spectrometry in a Time of Flight Instrument", Z. Naturforsch. 44a, Oct. 21, 1989, p. 1219-1225.

(Continued)

*Primary Examiner* — Wyatt A Stoffa
(74) *Attorney, Agent, or Firm* — Benoit & Côté Inc.

(57) ABSTRACT

The invention relates to the operation of an energy-focusing and solid-angle-focusing reflector for time-of-flight mass spectrometers with pulsed ion acceleration into a flight tube, e.g. from an ion source with ionization by matrix-assisted laser desorption (MALDI). The objective of the invention is to generate high mass resolution in wide mass ranges up to high masses above eight kilodaltons by varying at least one operating voltage on one of the diaphragms of the reflector which can be varied according to a suitable time function during the spectrum acquisition. It may also be advanta- (Continued)

geous to adapt the operation of the accelerating voltages in the starting region of the ions accordingly. These measures make it possible to achieve a mass resolution much higher than R=100,000 in a wide mass range extending up to and above eight kilodaltons.

21 Claims, 4 Drawing Sheets

(56) References Cited

U.S. PATENT DOCUMENTS 6,384,410 B1 * 5/2002 Kawato ..... H01J 49/405 250/281
6,740,872 B1 5/2004 Holle
7,589,319 B2 * 9/2009 Vestal ..... H01J 49/164 250/281
8,581,179 B2 11/2013 Franzen
8,664,592 B2 * 3/2014 Nishiguchi ..... H01J 49/405 250/281
8,772,708 B2 * 7/2014 Kinugawa ..... G01N 27/62 250/281
2001/0011703 A1 * 8/2001 Franzen ..... H01J 49/06 250/287
2002/0027194 A1 * 3/2002 Holle ..... H01J 49/40 250/287
2005/0098721 A1 * 5/2005 Bateman ..... H01J 49/0031 250/287
2009/0294642 A1 * 12/2009 Brown ..... H01J 49/0031 250/282
2011/0180702 A1 * 7/2011 Flory ..... H01J 49/406 250/282
2012/0145889 A1 * 6/2012 Vestal ..... H01J 49/403 250/282
2013/0168547 A1 * 7/2013 Nishiguchi ..... H01J 49/405 250/287
2014/0054456 A1 * 2/2014 Kinugawa ..... H01J 49/405 250/287
2014/0138538 A1 * 5/2014 Hieftje ..... H01J 49/40 250/282
2014/0312221 A1 * 10/2014 Verenchikov ..... H01J 49/405 250/282
2015/0270115 A1 * 9/2015 Furuhashi ..... H01J 49/405 250/287
2016/0005583 A1 * 1/2016 Goedecke ..... H01J 49/22 250/287
2016/0233075 A1 * 8/2016 Brown ..... H01J 49/06
2017/0154764 A1 * 6/2017 Furuhashi ..... H01J 9/062
2017/0358440 A1 * 12/2017 Furuhashi ..... H01J 37/266

FOREIGN PATENT DOCUMENTS

GB 2448203 A 10/2008
WO 03103008 A 12/2003

OTHER PUBLICATIONS

Moskovets, Eugene, "Optimization of the mass reflector parameters for direct ion extraction", Rapid Communications in Mass Spectrometry, Vo. 14, 2000, pp. 150-155.

* cited by examiner

WIDE-RANGE HIGH MASS RESOLUTION IN REFLECTOR TIME-OF-FLIGHT MASS SPECTROMETERS

BACKGROUND OF THE INVENTION

Field of the Invention

The invention relates to the operation of an energy-focusing and solid-angle-focusing reflector for time-of-flight mass spectrometers with pulsed ion acceleration into a time-of-flight tube, e.g. from an ion source with ionization by matrix-assisted laser desorption (MALDI).

Description of the Related Art

Two-stage reflectors with two grids between two field stages are known from the work of B. A. Mamyrin, V. I. Karatzev and D. V. Shmikk (U.S. Pat. No. 4,072,862 A). They allow a velocity-focusing ion reflection with adjustable focal length (usually called "energy focusing" nowadays). A first, strong opposing field decelerates the ions, while a second, very homogeneous field reflects the ions and in doing so brings about velocity focusing because ions of a higher velocity penetrate more deeply into the reflector and thus have to cover a greater distance, thereby experiencing a delay, which compensates for their higher velocity. The focal length of the energy focusing can be adjusted by adjusting the relative strengths of the deceleration field and reflection field. This reflector does not exhibit any solid-angle focusing. Instead of two-stage reflectors, it is also possible to use single-stage reflectors with only one grid in the entrance area. These have a fixed, relatively short focal length for the energy focusing and take up a large part of the total flight path of the time-of-flight mass spectrometer.

This Mamyrin reflector cannot, however, reflect fragment ions so that they are energy-focused because it reflects and simultaneously focuses only ions of the original energy, which all have the same penetration depth. In order to obtain focused mass spectra from fragment ions, Weinkauf et al. therefore developed a method to vary the reflector voltage between different, successive acquisitions of a fragment ion spectrum such that the fragment ions, whose kinetic energy is proportional to their mass, all have the same penetration depth into the reflector and are thus all well focused over a spectral acquisition cycle ("Laser Tandem Mass Spectrometry in a Time of Flight Instrument", R. Weinkauf, K. Walter, C. Weickhardt, U. Boesl, E. W. Schlag; Z. Naturforschg. 44a, 1219-1225; 1989). With this approach, the different spectra, which were all acquired separately with slightly different reflector voltages and thus all exhibit mass ranges which are well focused but shifted slightly with respect to each other, are subsequently combined mathematically such that only the regions of optimum resolution are taken into account in the calculated spectrum. This method is very time consuming and therefore unwieldy because of the necessity to acquire a large number of individual spectra with slightly different voltage settings. Furthermore, a special method is required to produce the fragment ions which operates with two laser systems. This explains why it has never become a routine method.

In a time-of-flight mass spectrometer with an ion reflector located after the ion source and before the ion detector, in order to compensate for different starting energies of ions of equal masses, it has been suggested to provide at least one electrode to act on the ions after reflection and to which a pulsed high voltage (rise time one kilovolt per ten nanoseconds) is applied in such a way that within a predetermined narrow range of ion masses, such as ten atomic mass units, time-of-flight errors for ions of equal masses due to different formation locations or times in the ion source are compensated for at the ion detector, see GB 2 295 720 B (corresponding to U.S. Pat. No. 5,739,529 A and DE 44 42 348 A1). In so doing, apart from energy compensation, also time-of-flight errors of the ions under investigation can simultaneously be compensated for. The electrode(s) may be located downstream of the reflector or incorporated in the reflector.

The work published by R. Frey and E. W. Schlag (EP 0 208 894 B1; U.S. Pat. No. 4,731,532 A) has disclosed grid-free, two-stage reflectors which have solid-angle focusing in addition to velocity focusing. They require a punctiform source for the ions, as is approximately provided by ionization by matrix-assisted laser desorption (MALDI), for example. The grid-free reflector is constructed from a number of metal ring diaphragms and a terminal plate electrode. A high deceleration field is generated at the first two or three ring diaphragms by applying a high potential difference. The equipotential lines which emerge through the diaphragm apertures form the solid-angle focusing ion lens. The other ring diaphragms have the same inside diameter, the same separations, and the same potential differences: they form a homogeneous reflection field which produces the energy focusing for ions of different energies by means of differing penetration depths (and therefore flight paths of different lengths). The focal length of the energy focusing is set by adjusting the ratio of the field strengths in the deceleration and the reflection fields—as is the case with the grid reflector. But this entails a rigidly coupled setting of the solid-angle focusing, whose focal length is not normally the same as that of the energy focusing. The focal lengths of the velocity focusing and of the solid-angle focusing cannot be set independently of each other; there is only one specific geometric arrangement which images a slightly divergent ion beam originating from a source onto an ion detector with both velocity focusing and solid-angle focusing.

The patent specification DE 196 38 577 C1 ("Simultaneous focusing of all masses in time-of-flight mass spectrometers"; J. Franzen, 1996) explains how, in an ion source with ionization by matrix-assisted laser desorption (MALDI), an acceleration voltage in the ion source, which is switched on as usual after a time delay but is then varied continuously during the further acceleration, leads to a mass resolution which not only produces a high resolution value at one mass, but a relatively high resolution over a wider mass range, for example two kilodaltons. This technique has become widely known under the name "Pan". The amplitude and geometric center of the mass resolution as a function of the mass can be altered by a time constant $\tau$ for the change function and shifted over the mass range.

The patent specification U.S. Pat. No. 6,740,872 B1 ("Space Angle Focusing Reflector for Time-of-Flight Mass Spectrometers", A. Holle, 2002) describes how an additional focusing can be generated in a reflector by introducing a static field inhomogeneity with slightly curved equipotential surfaces in the rear part of the reflector, particularly at the reversal point of the ions. It can be generated and adjusted by a voltage $U_3$ which is fed specifically to one of the last diaphragms of the reflector (preferably to the third-from-last diaphragm). For gridless reflectors, which already possess solid-angle focusing, the focal length of the solid-angle focusing can be varied by this procedure, adjusted to the focal length of the velocity focusing, and directed onto the detector. The mass resolution is also increased by this measure.

"In-Source Decay" is the term given to a special operating mode of a MALDI ion source. It operates with relatively intense but very short laser pulses, usually less than three nanoseconds. As a result, fragment ions are produced from the samples, which contain protein molecules, even before the acceleration is used, an amino acid being cleaved at a characteristic position in each protein molecule. Statistically, all the amino acids are involved in the cleaving across all protein molecules. A mass spectrum with two ladders of fragment masses is thus produced from a sample of a pure protein (or a pure, enzymatically produced protein digest fragment), one ladder from the N-terminus and one from the C-terminus. From these ladders, the sequence of the amino acids of this protein can be read off (see for example the patent specification U.S. Pat. No. 8,581,179 B2 "Protein Sequencing with MALDI Mass Spectrometry"; J. Franzen, 2010). For economic operation, however, it must be possible to measure the mass spectrum over a wide range of up to around 12 kilodaltons (around 100 amino acids) with sufficient sensitivity and sufficient mass resolution. It is then possible to sequence proteins or protein digest fragments up to a maximum length of around 200 amino acids in one step. As the previously used Edman sequencers are no longer manufactured, mass spectrometry promises a convenient and much faster replacement for this technology.

For this application to sequence proteins, and for many other applications also, there is a need for a mode of operation of a reflector time-of-flight mass spectrometer which has a better, relatively high mass resolution over a wide mass range. A higher mass resolution always means better sensitivity also, since the mass signals become narrower and thus higher, and exhibit a greatly improved signal-to-noise ratio.

SUMMARY OF THE INVENTION

The objective of the invention is to generate high mass resolutions up to high masses in the range above eight kilodaltons by using a suitably selected function to change at least one of the operating voltages on the diaphragms of the reflector, for example the focusing voltage $U_3$ on one of the rear diaphragms of the reflector, during the acquisition of a time-of-flight spectrum. The acquisition of a time-of-flight spectrum from the fastest to the slowest ion can be in the microsecond range; it can take around 100 microseconds, for example. One or more voltage sources, which tune(s) the voltages over such a time scale, can be used for the dynamic voltage supply to the one or more reflector diaphragms. The requisite variation in $U_3$ may amount to several volts, but particularly less than 200 volts. It shall be understood that the voltage variations also affect the voltages fed to the adjacent diaphragms (albeit to a lesser extent) when the reflector diaphragms are supplied at least in part via a chain of resistors. In particularly preferred embodiments, a rate of change in the at least one voltage on the at least one diaphragm of the reflector may be substantially less than 100 volts per nanosecond, such as less than 10 volts per nanosecond and/or in the range of several volts per microsecond.

It is also possible to vary the decelerating voltage $U_2$ instead of the focusing voltage $U_3$ during the spectral acquisition; or both voltages can be varied in time. Another possibility is to vary operating voltages on other inner diaphragms of the reflector while the spectra are being acquired in order to create suitable reflection conditions for the optimum focusing of each ion or fragment ion as it flies through the reflector.

Simulations have shown that it is also possible to adjust the setting of the starting region parameters of the ions in order to achieve a better result. It is preferable to choose a correspondingly advantageous time constant $\tau$, which describes the change in the accelerating voltage after the delayed switch-on of the acceleration in the starting region (e.g. in the MALDI source). In particular, it can be shortened in conjunction with the dynamic operation of the reflector.

The best possible time functions for the changes in the voltages, e.g. $U_3=f(t)$, can be determined in simulations. Simulations have shown that even above a mass m=8 kilodaltons, it is possible to achieve mass resolutions of $R=m/\Delta m>100{,}000$ ($\Delta m$ represents the full width at half-maximum of the ion signal). Resolution and sensitivity in this high mass range can thus be up to ten times higher than with the static reflector mode known to date. This facilitates the economically viable use of reflector time-of-flight mass spectrometers as protein sequencers, which requires the mass spectrum to be measured over a wide range of up to roughly 12 kilodaltons (around 100 amino acids) with sufficient sensitivity and sufficient mass resolving power, preferably spanning substantially more than 1000 Dalton, such as 2000 Dalton, 4000 Dalton, 6000 Dalton or more. It is thus possible to sequence proteins or protein digest fragments up to a length of around 200 amino acids in one step.

There are also many other possible applications for a reflector time-of-flight mass spectrometer with high mass resolution up to the high mass range, however. There is definitely a great need for gridless reflector mass spectrometers which have a mass determination precision of around one millionth of the mass (1 ppm) or better in the mass range up to ten or twelve kilodaltons. This can be achieved with this invention.

BRIEF DESCRIPTION OF THE DRAWINGS

The invention can be better understood by referring to the following illustrations. The elements in the illustrations are not necessarily to scale, emphasis instead being placed upon illustrating the principles of the invention (largely schematically).

DETAILED DESCRIPTION

While the invention has been illustrated and explained with reference to a number of embodiments, those skilled in the art will recognize that various changes in form and detail may be made herein without departing from the scope of the technical teaching as defined in the enclosed claims.

The objective of the invention is to generate high mass resolution over wide mass ranges up to high masses of, for example, around twelve kilodaltons (one dalton corresponds to one atomic mass unit u) by varying at least one voltage on one of the diaphragms of the reflector according to a suitable time function while the spectrum is being acquired so that the different ions which pass successively through the reflector are subjected to the most favorable reflector settings so as to be optimally focused.

Figure 1:
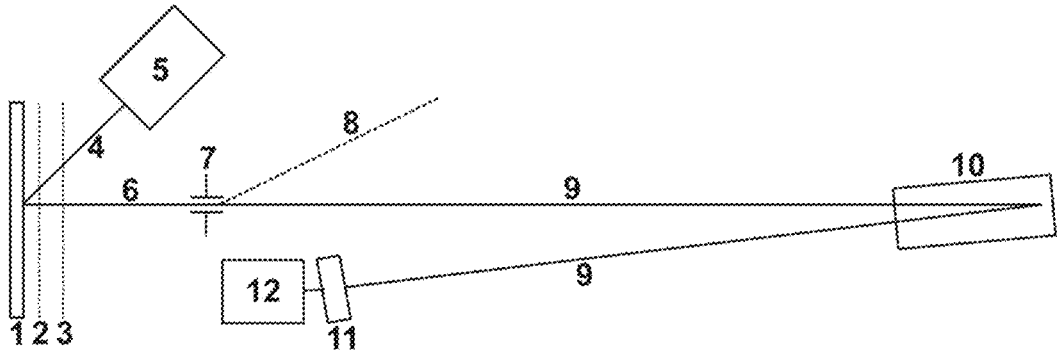
FIG. 1 shows a schematic of a simple MALDI time-of-flight mass spectrometer whose reflector (10) can be used for this invention. A relatively large number of samples or a tissue section to be imaged are/is located on the sample support plate (1) opposite the acceleration electrodes (2) and (3), and, by moving the sample support plate (1), the samples can be brought into the focus of the pulsed beam of laser light (4) from the laser (5), where they are ionized. The ions generated in the laser plasma are accelerated by the acceleration electrodes (2) and (3) after a time delay to form an ion beam (6), which must pass through the ion selector (7), and whose light ions (mainly ions of the matrix substance), can be deflected and removed as a separate beam (8) below a flight time limit. The remaining ion beam (9) of heavier analyte ions is then reflected by the reflector (10) onto the secondary electron multiplier (11). The output current from the secondary electron multiplier is fed to the transient recorder (12), where it is converted into a series of digital measurements.

How a MALDI time-of-flight mass spectrometer operates can be seen from the rough schematic in FIG. 1. A relatively large number of samples or a tissue section to be imaged are/is located on the sample support plate (1) opposite the acceleration electrodes (2) and (3), which are drawn here as a grid, but in real embodiments are used in the form of apertured diaphragms. The samples consist largely of crystals of a matrix substance with embedded analyte molecules in concentrations of a few hundredths of a percent. The samples can be brought into the focus of the pulsed beam of laser light (4) from the laser (5) by moving the sample support plate (1).

A small quantity of the sample from its surface is converted into a plasma by the pulse of laser light, which is at a high pressure and a high temperature. The plasma initially has the same volume as the solid, but immediately begins to expand and to undergo adiabatic cooling. In the plasma, ions of the matrix substance ionize a large number of analyte molecules by means of protonation. After around 500 to 1,000 nanoseconds, the plasma has expanded to a diameter of around 0.5 to 1.0 millimeters and the outer particles have lost contact with each other. No further ionization or adiabatic cooling now takes place. The plasma particles, and thus the ions also, exhibit a regular velocity distribution: the velocity of the particles in the plasma is higher, the further they are from the sample surface. This can be reproduced in simulations by computer programs.

The ions are accelerated by the acceleration voltage on the electrodes (2) and (3), which is switched on after a time delay, to form an ion beam (6). An ion selector (7) allows the removal of the large number of matrix ions of low mass in order to protect the detector (11) from becoming overloaded and contaminated. The remaining ion beam (9) of heavier ions is then reflected by the reflector (10) onto the flat detector (11) and focused according to both the energy of the ions and the solid angle. The detector can take the form of a secondary electron amplifier, for example. The output current from the secondary electron multiplier is fed to the transient recorder (12), where it is converted into a series of digital measurement values which represent the time-of-flight spectrum and, after appropriate calibration and conversion, the mass spectrum.

Figure 2:
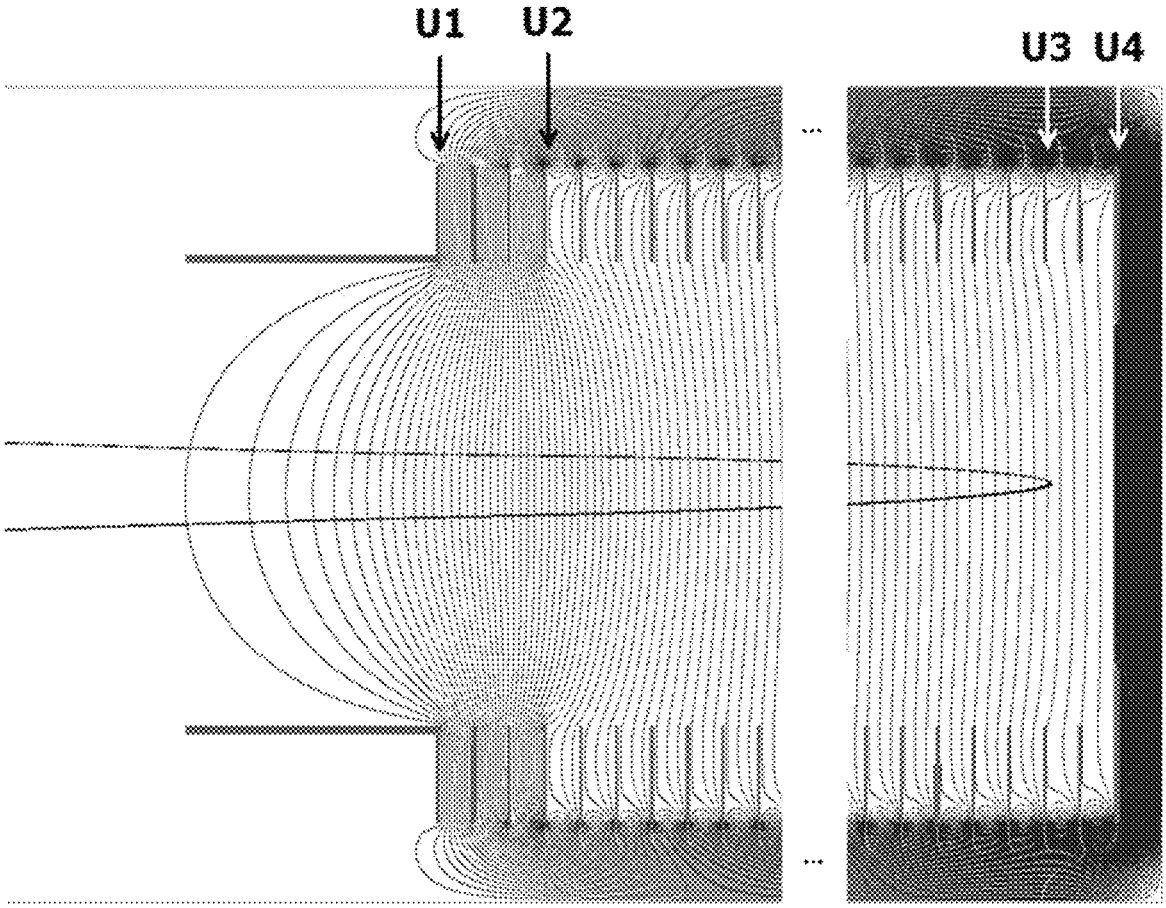
FIG. 2 depicts an example of a gridless reflector, corresponding to the reflector (10) from FIG. 1, together with the equipotential surfaces of its electric field. The high deceleration potential between $U_1$ and $U_2$ creates an ion lens which brings about an initial solid-angle focusing. The potential $U_3$ bends the equipotential surfaces slightly in the vicinity of the point of reversal, thus bringing about a second, adjustable focusing, which can be used to adjust the focal lengths of the energy focusing and the solid-angle focusing so that they match, and to direct them onto the detector.

In order to keep the long flight paths (6, 9) at ground potential and also to enable the detector (11) to be operated at ground potential, it is customary to keep both the voltages of the sample support plate (1) and the voltage at the end of the reflector (10) at a high level in the order of 20 kilovolts. The focusing voltage $U_3$ in the reflector (10) is therefore at a high potential also. This voltage is thus not so easy to control, but nowadays this is easily feasible from a technical point of view. FIG. 2 depicts the reflector with its diaphragms and the equipotential surfaces of the electric field resulting from the voltages applied. The effect of the lens at the entrance of the reflector can be clearly seen, but the focusing effect in the rear part of the reflector is less clear. This is due to the fact that the equipotential surfaces in the rear part of the reflector need to deviate only slightly from plane surfaces in order to have an effect because here, near the point of reversal, the ions possess hardly any kinetic energy and can therefore be influenced very easily.

As was explained above, a grid-free reflector preferably has a number of metal ring diaphragms and a terminating plate electrode, as schematically indicated in FIG. 2. A large deceleration field can be generated at the first two or three ring diaphragms by applying a high potential difference. The equipotential lines which emerge through the diaphragm apertures form the solid-angle focusing ion lens. The other ring diaphragms preferably have the same inner diameter, the same separations and the same potential differences: they can thus form a homogeneous reflection field, which provides the energy focusing for ions of slightly different energies by means of penetration depths of different magnitudes (and therefore flight paths of different lengths). The focal length of the energy focusing can be adjusted by means of the ratio of the field strengths in the deceleration and the reflection fields—in a similar way to the procedure used with a grid reflector.

As has been briefly described above, the objective of the invention is to generate high mass resolution up to high masses in the range above eight kilodaltons by varying at least one of the operating voltages of the reflector by means of a favorably selected time function while a time-of-flight spectrum is being acquired. As part of this disclosure, the effect on the mass resolution which is produced by a change to the focusing voltage $U_3$ (see FIG. 2) on one of the rear diaphragms of the reflector during the spectral acquisition is explained with the aid of mathematical simulations. Several results from the simulations are shown in FIGS. 3 and 4.

These simulations have shown that it is also possible to adapt the setting of the starting region parameters in order to achieve even better results. The time constant $\tau$, in particular, which describes the change in the acceleration voltage after a delayed switch-on of the acceleration in a MALDI ion source, can be chosen so as to be correspondingly advantageous. FIG. 3 here shows the mass resolution obtained as the optimum as a function of mass (curve 20) for changes in the voltage $U_3$ during the spectral acquisition for $\tau$=700 nanoseconds, which corresponds to the normal mode of a MALDI ion source up to now, compared to the mass resolution which is achieved in conventional static reflector mode (curve 21). A mass resolution above R=70,000 in the high mass range above 8,000 Daltons was achieved. Moreover, a higher mass resolution always goes hand-in-hand with better sensitivity because the mass signals in the spectrum become narrower and thus higher, and thus exhibit a better signal-to-noise ratio.

Figure 4:
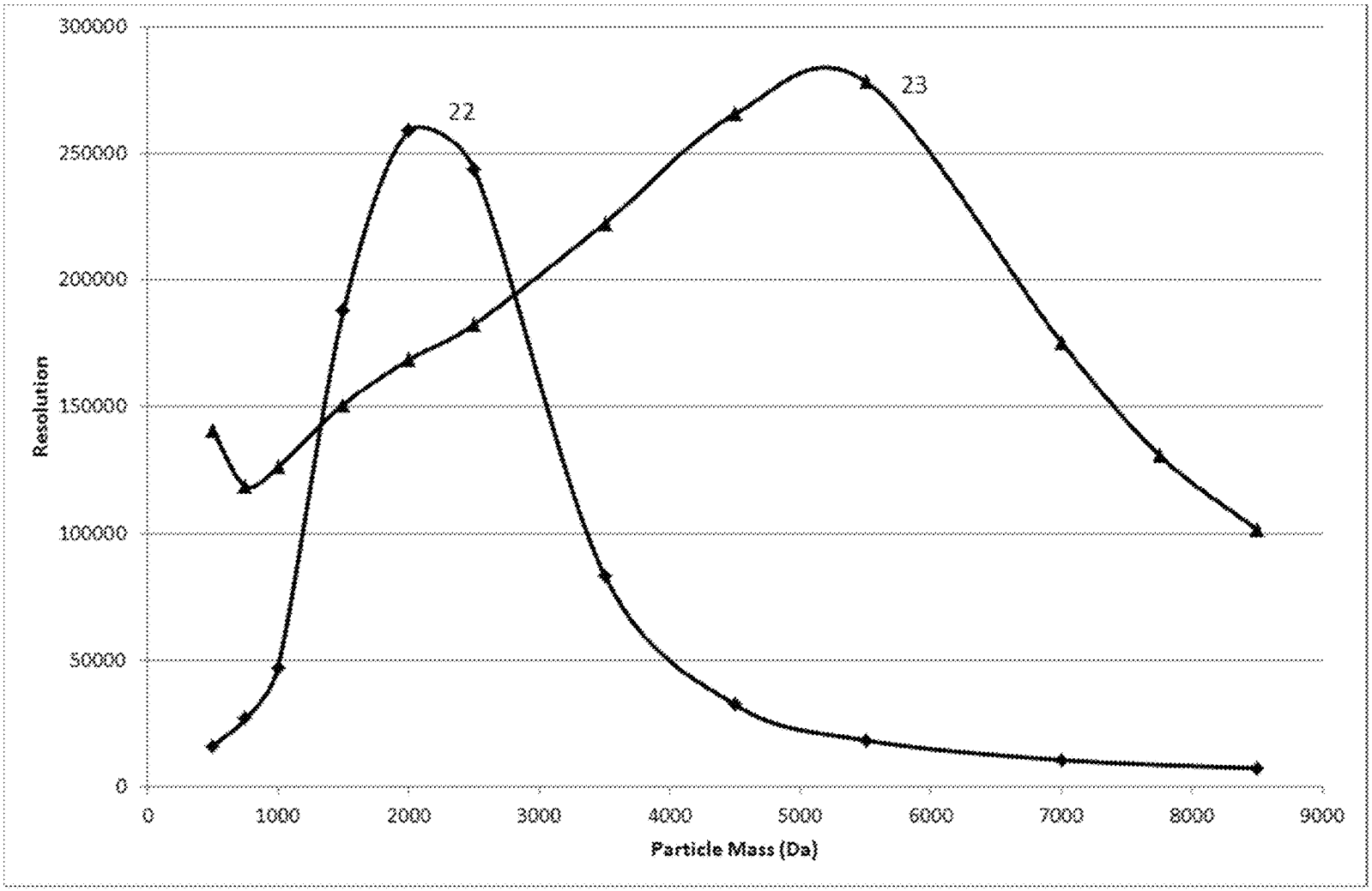
In FIG. 4, the parameter $\tau$ for the change in the acceleration voltage in the starting region (e.g. in the ion source) is additionally changed from $\tau$=700 nanoseconds to $\tau$=300 nanoseconds so that a mass resolution much higher than R=100,000 is achieved over the whole mass range up to and above than mass m=8,000 Daltons (curve 23). The resolutions in the static reflector mode used up to now are depicted in curve 22. Other combinations of $\tau$ and $U_3$=f(t) or the introduction of further voltage changes may result in even higher mass resolutions over even wider mass ranges and can be determined without too much effort either experimentally or by simulation.

If the time constant $\tau$ of the accelerating voltage in the MALDI ion source is reduced to 300 nanoseconds, an optimal change function $U_3$=f(t) gives rise to the mass resolution of curve 23 in FIG. 4, which are far above R=100,000 over the whole mass range extending up to and above m=8000 Daltons.

Figure 3:
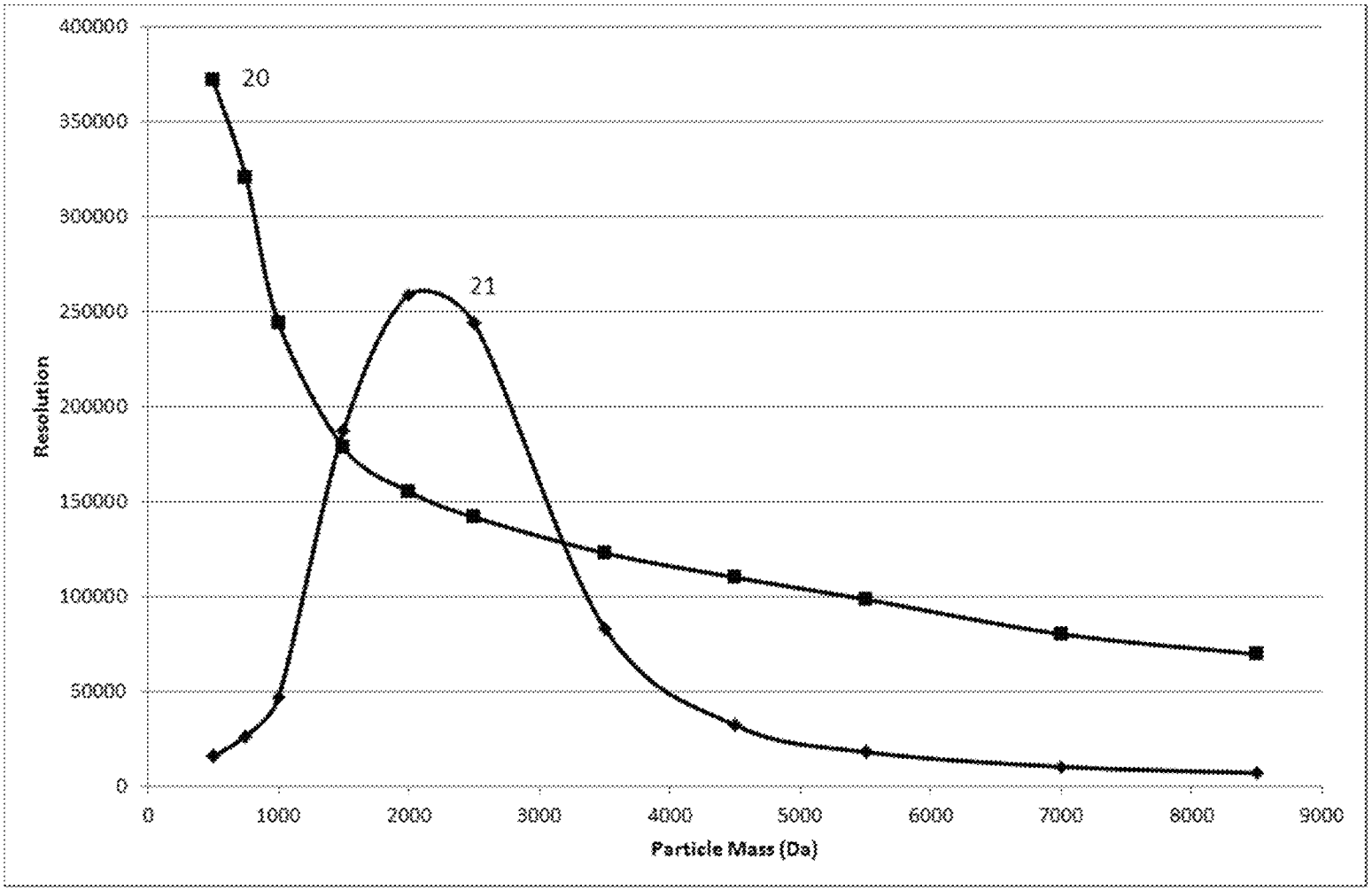
FIG. 3 depicts simulation results for the mass resolution as a function of the ion mass for various settings. Although the static reflector mode used at present (curve 21) achieves a resolution of R>150,000 (maximum ~250,000) in the range between approx. m=1,300 and m=3,000 Daltons, the resolution achieved at around m=8,500 is only around R=8,000, so that it is no longer possible to resolve isotopes, for example. If the voltage $U_3$ is suitably changed during the spectral acquisition according to the invention, the mass resolution in this range can be improved to R=70,000 (curve 20).
Figure 5:
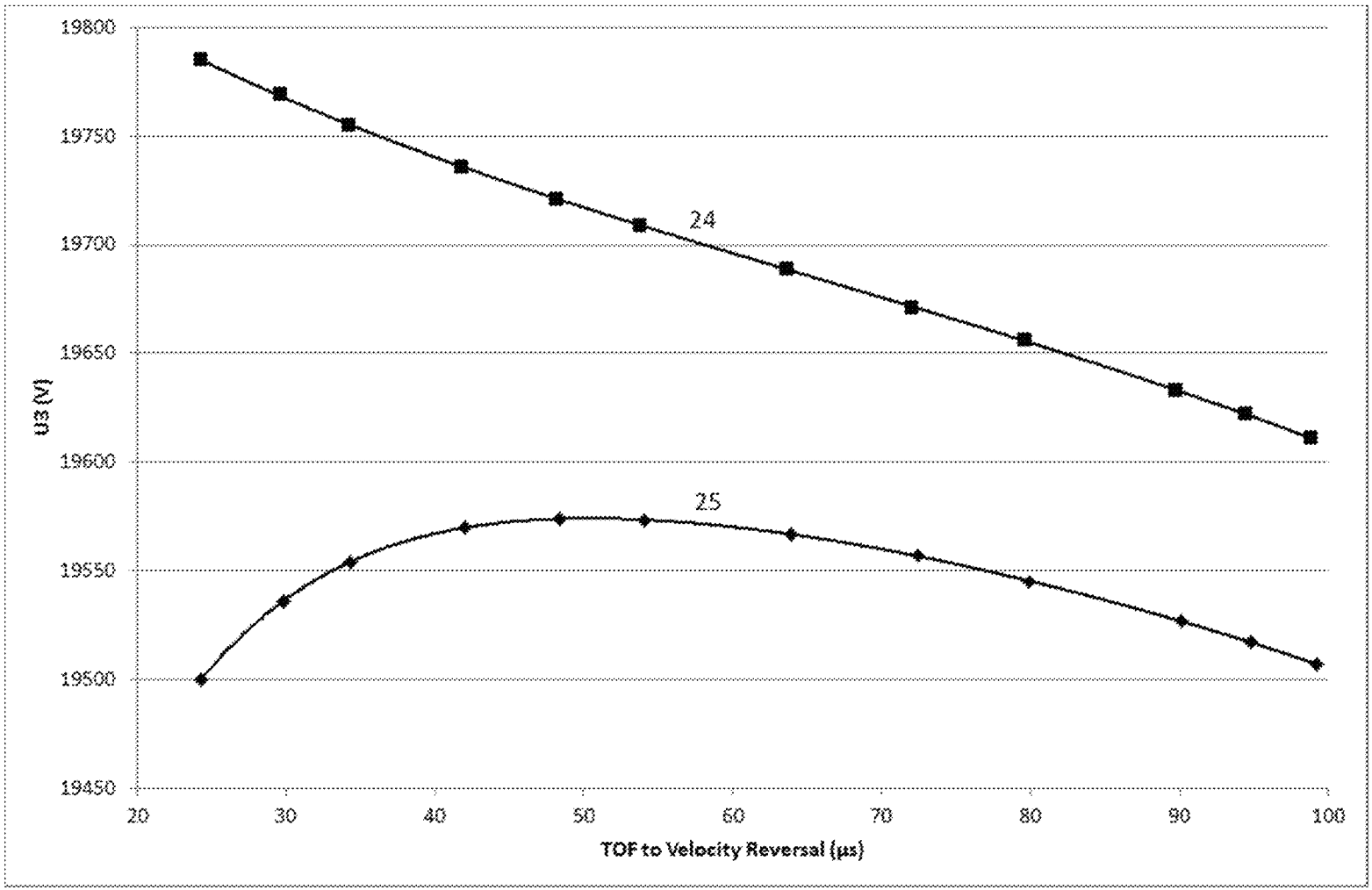
FIG. 5 shows suitable functions $U_3$=f(t) for the change of the voltage $U_3$ which were found in simulations. Curve 25 in conjunction with $\tau$=700 nanoseconds generates curve 20 in FIG. 3; curve 24 with $\tau$=300 nanoseconds generates curve 23 in FIG. 4. The necessary voltage changes during the spectral acquisition are less than 200 volts in these examples, which can easily be implemented electronically despite the short time span.

FIG. 5 depicts the associated optimal functions $U_3$=f(t) for the change to the focusing voltage $U_3$ for curves 20 and 23 in FIGS. 3 and 4. The acquisition of a mass spectrum takes around 100 microseconds in this example. The necessary change to $U_3$ amounts to less than 200 volts, as can be seen in FIG. 5.

The mathematical functions which describe the optimum changes to the voltages can be determined quite precisely in simulations. In these simulations to date, it was found that even above a mass m=8 kilodaltons, it is still possible to achieve a mass resolution of $R=m/\Delta m>100{,}000$ ($\Delta m$ represents the full width at half-maximum of the ion signal).

Earlier simulations of reflector time-of-flight mass spectrometers showed that these types of simulations reproduce the experimental situations which are actually observed quite well. These simulations therefore lead to the conclusion that the improvements in resolution over a wide mass range which occur in practice come quite close to the calculated ones. It is even to be expected that still higher resolution can be achieved over the whole mass range, and particularly in the high mass range above m=8 kilodaltons, given appropriately adapted changes in the starting region of the ions, for example other values for $\tau$ in an ion source, or given additional, variable voltages on other diaphragms of the reflector. It is also possible to vary the deceleration voltage $U_2$ instead of or in addition to the focusing voltage $U_3$ during the spectral acquisition, for example. Other time constants $\tau$ can also be used to change the accelerating voltage in the starting region, or it is even possible to use a different function than the exponential function used to date to vary the accelerating voltage in the starting region.

The results of the simulations are astonishing to the specialist because in the 40 or so years of MALDI time-of-flight mass spectrometry, attempts have repeatedly been made to improve the mass resolution, as explained in the introduction. This always involved a static reflector mode, however. The invention opens up new applications for mass spectrometry, and not only for use as a protein sequencer. New possibilities are thus also generated in the field of imaging mass spectrometry of tissue samples, for example. Hitherto, the proteins of tissue samples had to be converted into relatively small digest fragments with the aid of an enzymatic digest so that they could be measured in the optimal mass range of two to four kilodaltons in static reflector mode. The reconstruction of the proteins is easier, the larger the digest fragments which can be measured. The new method described can bring about an improvement here also.

The invention has been described above with reference to different, specific example embodiments. It is to be understood, however, that various aspects or details of the embodiments described can be modified without deviating from the scope of the invention. In particular, features and measures disclosed in connection with different embodiments can be combined as desired if this appears feasible to a person skilled in the art. In addition, the above description serves only as an illustration of the invention and not as a limitation of the scope of protection, which is exclusively defined by the enclosed claims, taking into account any equivalents which may possibly exist.

The invention claimed is:

1. A method for operating a reflector time-of-flight mass spectrometer, in which ions are accelerated in the form of pulses from a starting region, pass through a reflector, which comprises a plurality of diaphragms supplied with predefined voltages, and are then recorded as a time-of-flight spectrum, wherein at least one voltage on a diaphragm of the reflector is changed, in order to improve reflection conditions for the ions as they successively pass the reflector, during acquisition of a single time-of-flight spectrum as a function of the flight time that correlates with ion mass, and wherein a function for changing an accelerating voltage in the starting region is adapted to the change in the at least one diaphragm voltage after the accelerating voltage has been switched on with a time delay.

2. The method according to claim 1, wherein at least one of a focusing voltage U3 on one of the last diaphragms of the reflector and a decelerating voltage U2 on one of the first diaphragms of the reflector are varied during acquisition of the single time-of-flight spectrum.

3. The method according to claim 1, wherein a voltage is varied on more than one diaphragm of the reflector during acquisition of the single time-of-flight spectrum.

4. The method according to claim 1, wherein a parameter $\tau$ for the change to the accelerating voltage in the starting region is optimized.

5. The method according to claim 1, wherein the starting region comprises a MALDI ion source.

6. The method according to claim 1, wherein at least one of mass spectrometric images of tissue sections are measured and proteins sequenced.

7. The method according to claim 1, wherein the at least one voltage on the diaphragm of the reflector is changed during the acquisition of the single time-of-flight spectrum over a time period that corresponds to substantially more than a range of 1000 Dalton ion mass.

8. The method according to claim 1, wherein a rate of change in the at least one voltage on the diaphragm of the reflector is substantially less than 100 volts per nanosecond.

9. The method according to claim 2, wherein the focusing voltage U3 is varied by less than 200 volts.

10. The method according to claim 7, wherein the at least one voltage on the diaphragm of the reflector is changed during the acquisition of the single time-of-flight spectrum over a time period that corresponds to substantially more than a range of 2000 Dalton ion mass.

11. The method according to claim 7, wherein the at least one voltage on the diaphragm of the reflector is changed during the acquisition of the single time-of-flight spectrum over a time period that corresponds to substantially more than a range of 4000 Dalton ion mass.

12. The method according to claim 7, wherein the at least one voltage on the diaphragm of the reflector is changed during the acquisition of the single time-of-flight spectrum over a time period that corresponds to substantially more than a range of 6000 Dalton ion mass.

13. The method according to claim 1, wherein a rate of change in the at least one voltage on the diaphragm of the reflector is substantially less than one of 10 volts per nanosecond and several volts per microsecond.

14. A reflector time-of-flight mass spectrometer in which ions are accelerated in the form of pulses from a starting region, whose reflector comprises a plurality of diaphragms supplied with predetermined voltages, and which is equipped with an electronic system with which at least one voltage on at least one diaphragm of the reflector can be varied according to a pre-selected time function during a spectrum acquisition, wherein the electronic system is configured to vary the diaphragm voltage(s) on a microsecond timescale, and wherein a function for changing an accelerating voltage in the starting region is adapted to a change in the at least one diaphragm voltage after the accelerating voltage has been switched on with a time delay.

15. The reflector time-of-flight mass spectrometer according to claim 14, wherein the reflector is energy-focusing and solid-angle-focusing.

16. The reflector time-of-flight mass spectrometer according to claim 14, wherein the electronic system is configured to change the at least one voltage on the at least one diaphragm over a time period that corresponds to substantially more than a range of 1000 Dalton ion mass.

17. The reflector time-of-flight mass spectrometer according to claim 14, wherein the electronic system is configured to change the at least one voltage on the at least one diaphragm with a rate substantially less than 100 volts per nanosecond.

18. The reflector time-of-flight mass spectrometer according to claim 14, wherein the reflector is grid-free.

19. The reflector time-of-flight mass spectrometer according to claim 16, wherein the electronic system is configured to change the at least one voltage on the at least one diaphragm over a time period that corresponds to substantially more than a range of 2000 Dalton ion mass.

20. The reflector time-of-flight mass spectrometer according to claim 16, wherein the electronic system is configured to change the at least one voltage on the at least one diaphragm over a time period that corresponds to substantially more than a range of 4000 Dalton ion mass.

21. The reflector time-of-flight mass spectrometer according to claim 16, wherein the electronic system is configured to change the at least one voltage on the at least one diaphragm over a time period that corresponds to substantially more than a range of 6000 Dalton ion mass.

* * * * *